US007123871B2

(12) United States Patent
Nakai et al.

(10) Patent No.: US 7,123,871 B2
(45) Date of Patent: Oct. 17, 2006

(54) NEUTRALIZING APPARATUS AND IMAGE FORMING APPARATUS HAVING THE NEUTRALIZING APPARATUS

(75) Inventors: Tomoaki Nakai, Tokyo (JP); Michio Uchida, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/995,596

(22) Filed: Nov. 22, 2004

(65) Prior Publication Data

US 2005/0117939 A1 Jun. 2, 2005

(30) Foreign Application Priority Data

Nov. 28, 2003 (JP) ..... 2003-399883

(51) Int. Cl.
*G03G 15/16* (2006.01)

(52) U.S. Cl. ..... 399/315

(58) Field of Classification Search ..... 399/315
See application file for complete search history.

(56) References Cited

U.S. PATENT DOCUMENTS 5,633,703 A * 5/1997 Takenouchi et al. ..... 399/315
5,666,605 A * 9/1997 Tokimatsu et al. ..... 399/173
5,758,247 A * 5/1998 Yanashima et al. ..... 399/384
6,393,245 B1 * 5/2002 Jia et al. ..... 399/307

FOREIGN PATENT DOCUMENTS

JP 56-23955 U 3/1981
JP 62-075688 4/1987
JP 06-138776 A1 5/1994

* cited by examiner

*Primary Examiner*—William J. Royer
(74) *Attorney, Agent, or Firm*—Canon U.S.A. Inc I.P. Div

(57) ABSTRACT

An image forming apparatus having a sharp neutralizing member which can perform uniform neutralizing effects for a long period of time. The sharp neutralizing member includes sharp projections in which tip portions having the following relationship between a distance P between the tip portions of neighboring projections and the distance D between the tip portion of the projection and an object of neutralization:

$D \geqq 4.0$ mm, and $0.8*D \leqq P \leqq 1.5*D$. Particularly for neutralization of a carrier of toner images, it is possible to achieve uniform neutralization of the medium and to provide a high-quality image.

13 Claims, 15 Drawing Sheets

| | | CLEARANCE D (mm) | | | | | | |
|---|---|---|---|---|---|---|---|---|
| | | 2 | 3 | 4 | 5 | 6 | 7 | 8 |
| PITCH P (mm) | 2 | ○ | × | × | × | × | × | × |
| | 3 | ○ | ○ | × | × | × | × | × |
| | 4 | × | ○ | ○ | ○ | × | × | × |
| | 5 | × | × | ○ | ○ | ○ | × | × |
| | 6 | × | × | ○ | ○ | ○ | ○ | × |
| | 7 | × | × | × | ○ | ○ | ○ | ○ |
| | 8 | × | × | × | × | ○ | ○ | ○ |
| | 9 | × | × | × | × | ○ | ○ | ○ |
| | 10 | × | × | × | × | × | ○ | ○ |
| | 11 | × | × | × | × | × | × | ○ |
| | 12 | × | × | × | × | × | × | ○ |
| | 13 | × | × | × | × | × | × | × |
| | 14 | × | × | × | × | × | × | × |

| | CLEARANCE D (mm) | | | | | | |
|---|---|---|---|---|---|---|---|
| | 2 | 3 | 4 | 5 | 6 | 7 | 8 |
| STAIN IN NEUTRALIZING MEMBER | × | × | ○ | ○ | ○ | ○ | ○ |
| UNIFORMITY OF DISCHARGE | × | × | ○ | ○ | ○ | ○ | ○ |

FIG. 8

| | | CLEARANCE D (mm) | | | | | | |
|---|---|---|---|---|---|---|---|---|
| | | 2 | 3 | 4 | 5 | 6 | 7 | 8 |
| PITCH P (mm) | 2 | × | × | × | × | × | × | × |
| | 3 | × | × | × | × | × | × | × |
| | 4 | × | × | ○ | ○ | × | × | × |
| | 5 | × | × | ○ | ○ | ○ | × | × |
| | 6 | × | × | ○ | ○ | ○ | ○ | × |
| | 7 | × | × | × | ○ | ○ | ○ | ○ |
| | 8 | × | × | × | × | ○ | ○ | ○ |
| | 9 | × | × | × | × | ○ | ○ | ○ |
| | 10 | × | × | × | × | × | ○ | ○ |
| | 11 | × | × | × | × | × | × | ○ |
| | 12 | × | × | × | × | × | × | ○ |
| | 13 | × | × | × | × | × | × | × |
| | 14 | × | × | × | × | × | × | × |

NEUTRALIZING APPARATUS AND IMAGE FORMING APPARATUS HAVING THE NEUTRALIZING APPARATUS

BACKGROUND OF THE INVENTION

1. Field of the Invention

The present invention relates to an image forming apparatus using electrophotographic technology.

2. Description of the Related Art

Recently, image forming apparatuses such as copying machines which form images from image data, a facsimile machine or an image scanner used as a computer output device are being more widely used.

Many types of image forming means, including thermal fusion, thermal sublimation, thermal transfer, ink-jet, and electrophotographic, have been developed in response to user demands. Among others, a full-color electrophotographic image forming apparatus using four colors, including cyan, yellow, magenta and black, by arranging four process stations 1*a*, 1*b*, 1*c* and 1*d* that serve as image forming sections of different colors, as shown in FIG. 18, is now proposed.

In FIG. 18, the process stations 1*a* to 1*d* have photosensitive drums 2*a* to 2*d* serving as image carriers. After the surfaces of the photosensitive drums 2*a* to 2*d* are uniformly charged by primary chargers 3*a* to 3*d*, an electrostatic latent image is formed through exposure based on image information from exposure units 4*a* to 4*d*, such as LEDs (light emitting diodes) or lasers. Different kinds of toner for the individual colors are imparted to this electrostatic latent image, which is developed by developing units 5*a* to 5*d* into toner images.

The individual process stations 1*a* to 1*d* serving as process cartridges are detachable from the image forming apparatus main body. The individual process cartridge integrally combines the photosensitive drums 2*a* to 2*d*, the primary chargers 3*a* to 3*d*, the developing units 5*a* to 5*d*, and cleaning means 6*a* to 6*d*.

A transfer medium S serving as a recording medium housed in a paper feed cassette 15 is fed into the image forming apparatus main body by a paper feed roller 16, and conveyed by a resist roller pair 17. Then, the transfer medium S is electrostatically attracted by a transfer conveyor belt 7, serving as a transfer medium carrier, by an attracting roller 12 to which a positive attracting bias voltage is applied by an attracting bias power source 13.

The transfer conveyor belt 7 is attracted and supported by four rollers including a driving roller 8, an attraction opposing roller 9, and tension rollers 10 and 11. The process stations 1*a*, 1*b*, 1*c* and 1*d* of the individual colors, including cyan, yellow, magenta and black, are arranged substantially perpendicular to the surface of the transfer conveyor belt 7 and sequentially from an upstream side along the moving direction of the transfer conveyor belt 7 (as shown by arrow a).

The transfer medium S, attracted by the transfer conveyor belt 7, passes sequentially through the process stations 1*a* to 1*d* of the individual colors. The toner images of the individual colors carried on the photosensitive drums 2*a* to 2*d* are electrostatically transferred in sequence. Subsequently, these toner images are heated and pressurized by a fixing unit 18, whereby the toner images are fixed on the transfer medium S to form permanent images.

At this point in time, the transfer medium S, which is a dielectric such as paper or a synthetic resin, carries a large amount of charge since the transfer medium undergoes four runs of the transfer process while passing through the four process stations 1*a* to 1*d*.

As a result, a peeling-discharge phenomenon takes place, at a peeling-separation section, from the transfer conveyor belt 7 provided on the circumference of the driving roller 8, and the toner images, transferred onto the transfer medium S, are disturbed along the discharge pattern.

To solve this problem, it is the usual practice to arrange a neutralizer (neutralizing member) between the transfer conveyor belt 7 and the fixing unit 18, as shown in FIG. 18. For example, a defective image is prevented by arranging a wire-type corona charger 51, as shown in FIGS. 18 and 19, and neutralizing the transfer medium S by means of the corona charger 51 while peeling off the transfer medium S from the transfer conveyor belt 7, thereby preventing peeling discharge. The corona charger 51 includes a conduction shield 53 and a discharge wire 52.

However, use of a neutralizer having the above-mentioned configuration has the following problems.

Use of a wire-type corona charger as a neutralizer is characterized by stabilization of discharge and availability of a neutralizing effect. On the other hand, when cleaning stains off of the discharge wire 52, or when removing transfer medium jam, the discharge wire 52 tends to be easily broken or it is difficult to maintain a sufficient life or ensure safety.

There is available a neutralizing member using a sharp electrode as a neutralizing mechanism posing no risk of breakage of the discharge wire 52, as in a corona charger 51. Use of a sharp electrode can, however, pose other problems.

The neutralizing mechanism using a sharp electrode (needle electrode or the like) has conventionally been arranged near the object of neutralization, since the neutralizing effect becomes more remarkable as the distance between the object of neutralization and the sharp electrode becomes smaller. However, in the neutralizing member using the sharp electrode, the rise in discharge current from the proximity of the discharge threshold value (electric field condition for start of discharge) is steep, making it difficult to stabilize the neutralizing effect because of the unstable discharge.

That is, it has generally been recognized that, if the object of discharge may flap as the transfer medium, a neutralizing member using a sharp electrode did not achieve uniform neutralization. When the distance between the neutralizing member and the object of neutralization is small, an increase in the number of transfers of the object of neutralization in the proximity of the neutralizing member causes adhesion of dust resulting from the object of neutralization itself, to the neutralizing member and an abnormal discharge at this adhesion, thus causing a problem in that the expected neutralizing effect cannot be achieved.

SUMMARY OF THE INVENTION

The present invention is directed to an image forming apparatus having a sharp neutralizing member.

The sharp neutralizing member ensures a uniform neutralizing effect for a long period of time on an object of neutralization. For example, for neutralization of an image carrier carrying a toner image, uniform neutralization of the entire image carrier can be achieved, and a high-quality toner image can be obtained.

In one aspect of the present invention, an image forming apparatus is operable to form images on a transfer medium. The apparatus includes a carrier configured to carry the transfer medium along a moving path and a neutralizing member which is configured to neutralize the transfer medium. The neutralizing member includes a first projection and a second projection adjacent to the first projection, wherein the first and second projections have first and second tip portions, respectively, and configured to neutralize the transfer medium. A minimum distance D1 between the first tip portion and the moving path of the transfer medium, a minimum distance D2 between the second tip portion and the moving path of the transfer medium, and a perpendicular distance P between the first tip portion and the second tip portion satisfy the following formulas:

$$D1 \geqq 4.0 \text{ mm}, \ 0.8*D1 \leqq P \leqq 1.5*D1$$

$$D2 \geqq 4.0 \text{ mm}, \ 0.8*D2 \leqq P \leqq 1.5*D2.$$

In another aspect of the present invention, an image forming apparatus includes a toner image carrier configured to carry a toner image; and a neutralizing member configured to neutralize the toner image carrier. The neutralizing member has a first projection and a second projection adjacent to the first projection, wherein the first and second projections have first and second tip portions, respectively. A minimum distance D1 between the first tip portion and the toner image carrier, a minimum distance D2 between the second tip portion and the toner image carrier, and a perpendicular distance P between the first tip portion and the second tip portion satisfy the following formulae:

$$D1 \geqq 4.0 \text{ mm}, \ 0.8*D1 \leqq P \leqq 1.5*D1$$

$$D2 \geqq 4.0 \text{ mm}, \ 0.8*D2 \leqq P \leqq 1.5*D2.$$

In still another aspect of the present invention, an image forming apparatus includes a conveyor configured to convey toner images; and a neutralizing member configured to neutralize the conveyor. The neutralizing member has a first projection and a second projection adjacent to the first projection. The first and second projections have first and second tip portions, respectively. A minimum distance D1 between the first tip portion and the conveyor, a minimum distance D2 between the second tip portion and the conveyor, and a perpendicular distance P between the first tip portion and the second tip portion satisfy the following formulae:

$$D1 \geqq 4.0 \text{ mm}, \ 0.8*D1 \leqq P \leqq 1.5*D1,$$

$$D2 \geqq 4.0 \text{ mm}, \ 0.8*D2 \leqq P \leqq 1.5*D2.$$

Further features and advantages of the present invention will become apparent from the following description of the embodiments (with reference to the attached drawings).

BRIEF DESCRIPTION OF THE DRAWINGS

FIG. 8 illustrates a defective image resulting from an image output of 50,000 pages, regarding the relationship of occurrence of a defective image between the clearance D between the needle tip of a needle electrode and an object of neutralization and the clearance P between needle tips of a plurality of needle electrodes in the neutralizing unit of the first embodiment of the present invention;

DESCRIPTION OF THE EMBODIMENTS

The image forming apparatus of the present invention will now be described in detail with reference to the drawings.

First Embodiment

[Outline of Image Forming Apparatus]

An embodiment of the image forming apparatus using the full-color electrophotographic method will be described in detail as an example of the neutralizing unit of the present invention and the image forming apparatus having such a neutralizing unit with reference to the drawings.

Figure 1:
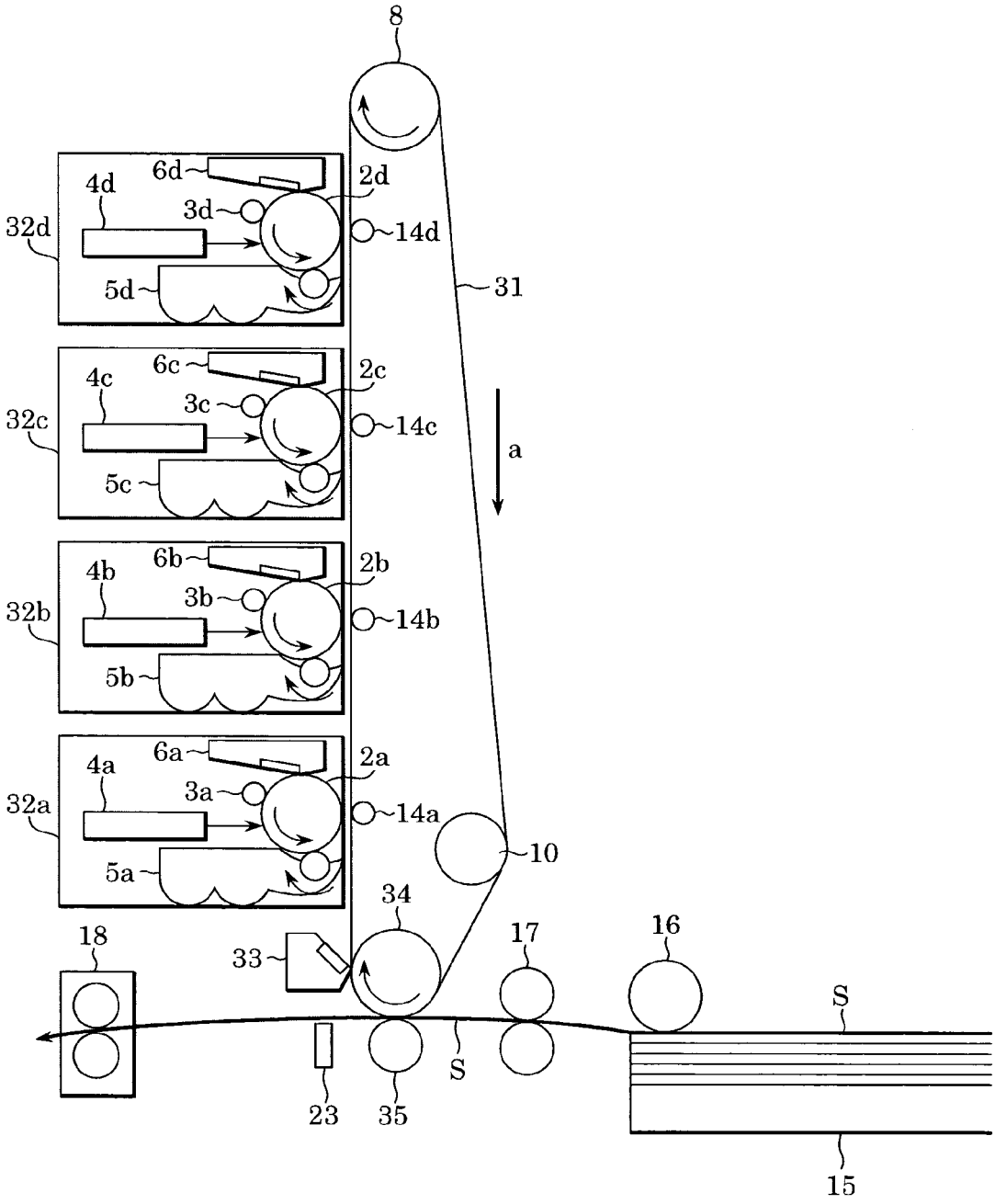
FIG. 1 is a sectional view illustrating a schematic configuration of a first embodiment of the image forming apparatus of the present invention.
Figure 2:
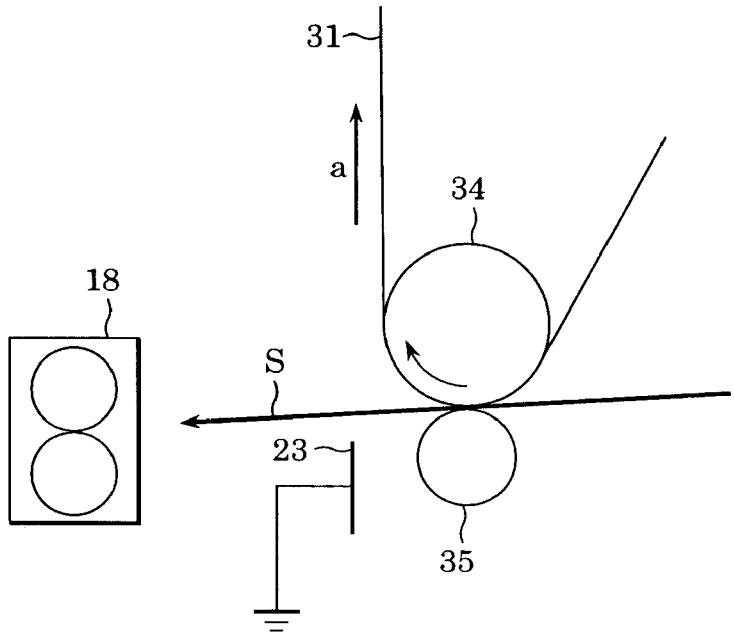
FIG. 2 is a partially enlarged view illustrating the layout configuration of a first embodiment of the neutralizing unit of the present invention.
Figure 3:
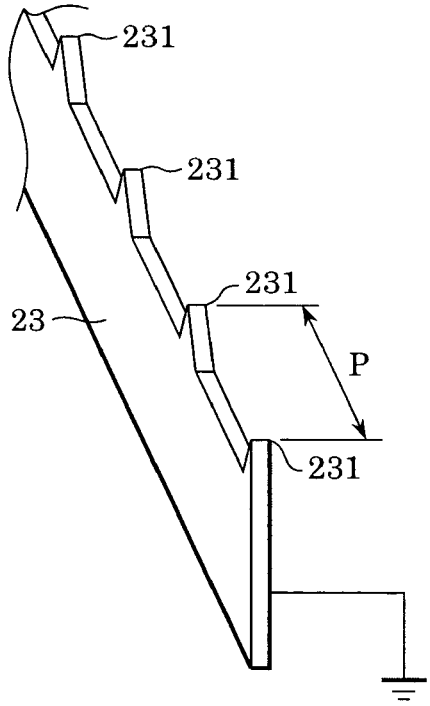
FIG. 3 is a perspective descriptive view illustrating the configuration of the first embodiment of the neutralizing unit of the present invention.
Figures 4, 5:
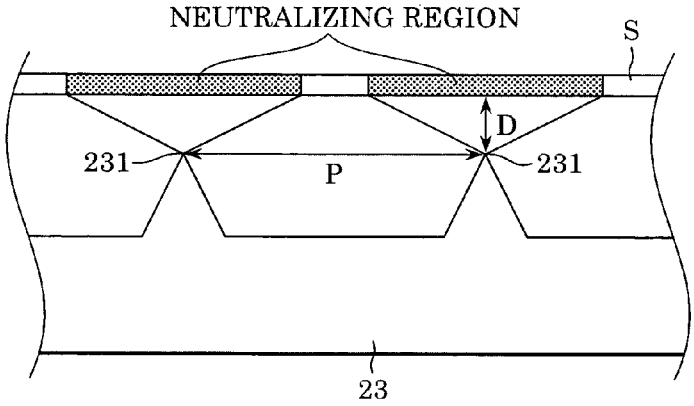
FIG. 4 illustrates the relationship between the clearance D between the needle tip of a needle electrode and an object of neutralization and occurrence of a defective image at the mutual clearance P of needle tips of a plurality of needle electrodes.
FIG. 5 illustrates the mechanism of occurrence of a defective image in the neutralizing unit of the first embodiment of the present invention.
Figures 6, 7:
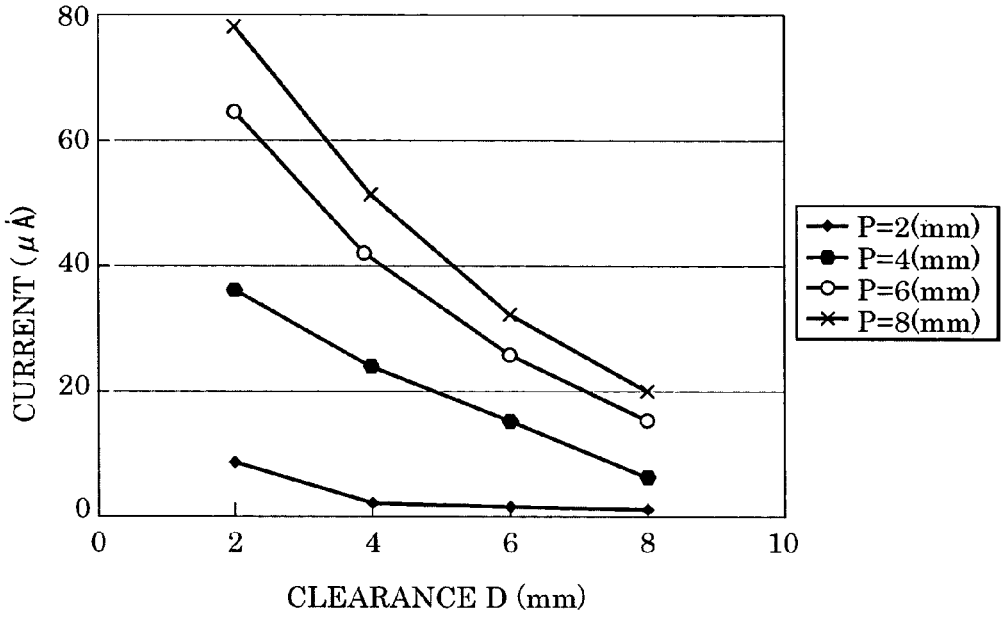
FIG. 6 illustrates the relationship between the clearance D between the needle tip of the needle electrode and the metal member and the discharge current when metal members are arranged at the needle tip of the needle electrode and the portion opposite thereto in the neutralizing unit of the first embodiment of the present invention.
FIG. 7 illustrates the relationship between the extent of stains on the neutralizing member and discharge non-uniformity when outputting 50,000 sheets of an image in the neutralizing unit of the first embodiment of the present invention.

FIG. 1 is a sectional view illustrating a schematic configuration of an image forming apparatus of the present invention. FIG. 2 is a partially enlarged view illustrating the layout configuration of the neutralizing unit of the present invention. FIG. 3 is a perspective view illustrating the configuration of the first embodiment of the neutralizing unit of the present invention. FIG. 4 is a table showing, in the neutralizing unit of the first embodiment, the relationship regarding occurrence of a defective image between the clearance D between the tips of teeth of the saw-toothed electrodes, which are sharp electrodes, and the transfer medium, which is an object of neutralization, on the one hand, and the mutual clearance P of the tips of the teeth of a plurality of saw-toothed electrodes, on the other hand. FIG. 5 illustrates the mechanism of occurrence of a defective image in the neutralizing unit of the first embodiment. FIG. 6 illustrates, in the neutralizing unit of the first embodiment, in which metal members are arranged on the tips of the teeth of the saw-toothed electrodes and the portions opposite thereto, and in which a potential difference of 3 kV is provided, the discharge current relationship between the clearance D between the tips of the teeth of the saw-toothed electrodes and the metal members, on the one hand, and the mutual clearance P of the tips of the teeth of the plurality of saw-toothed electrodes, on the other hand.

The whole configuration of the image forming apparatus having the neutralizing member of the present invention will first be described with reference to FIG. 1. The image forming apparatus shown in FIG. 1 is configured as an image forming apparatus based on the four-color full-color electrophotographic method, in which four process stations 32*a*, 32*b*, 32*c* and 32*d* serving as image forming means of four different colors including cyan, yellow, magenta and black are arranged.

The process stations 32*a* to 32*d* have photosensitive drums 2*a*, 2*b*, 2*c* and 2*d* serving as image carriers. The surfaces of the photosensitive drums 2*a* to 2*d* are uniformly charged by primary chargers 3*a*, 3*b*, 3*c* and 3*d* arranged around the respective photosensitive drums 2*a* to 2*d*, and are then subjected to exposure based on image information by exposure units 4*a*, 4*b*, 4*c* and 4*d*, such as LEDs (light emitting diodes) or lasers, whereby electrostatic latent images are formed. The resultant electrostatic latent image to which different kinds of toner of the individual colors are deposited by developing units 5*a*, 5*b*, 5*c* and 5*d* are developed as toner images.

The individual process stations 32*a* to 32*d* are detachable from the image forming apparatus main body as process cartridges. The individual process cartridges are composed of integrally combined respective photosensitive drums 2*a* to 2*d*, primary chargers 3*a* to 3*d*, developing units 5*a* to 5*d*, and cleaning means 6*a*, 6*b*, 6*c* and 6*d*.

The transfer medium S serving as a recording medium housed in a paper feed cassette 15 is fed into the image forming apparatus main body, and is conveyed by a resist roller pair 17.

An intermediate transfer belt 31 is stretched by three rollers including a driving roller 8, a transfer counter roller 34, and a tension roller 10. The process stations 32*a* to 32*d* of the individual colors including cyan, yellow, magenta and black are arranged sequentially from an upstream side along the moving direction of the intermediate transfer belt 31 (the arrow a direction in FIG. 1) and substantially perpendicular to the surface of the intermediate transfer belt 31.

Transfer rollers 14*a*, 14*b*, 14*c* and 14*d*, serving as a transfer mechanism, are arranged on the inside of the intermediate transfer belt 31, opposite to the corresponding photosensitive drums 2*a* to 2*d*. Upon sequentially passing through the process stations 32*a* to 32*d* of the individual colors, the toner images of the individual colors carried on the respective photosensitive drums 2*a* to 2*d* are sequentially transferred electrostatically onto the surface of the intermediate transfer belt 31 by means of the individual transfer rollers 14*a* to 14*d*.

The transfer medium S is conveyed from the resist roller at a prescribed timing, and at the nip portions of the intermediate transfer belt 31 and a transfer roller 35, the toner images on the intermediate transfer belt 31 are transferred onto the transfer medium S.

A fixing unit 18, serving as a fixing device, is arranged downstream of the transfer roller 35 in the conveying direction of the recording medium. Through heating and pressurizing in the fixing unit 18, the toner images are fixed onto the transfer medium S to form a permanent image.

Residual toner remaining on the individual photosensitive drums 2*a* to 2*d* is collected by respective cleaning unit 6*a* to 6*d* so that the surfaces of the photosensitive drums are cleaned. Residual toner remaining on the intermediate transfer belt 31 is collected by a cleaning unit 33, thus cleaning the surface of the intermediate transfer belt 31.

[Configuration of Neutralizing Member in this Embodiment]

A neutralizing member 23 includes a plurality of saw-toothed electrodes 231, as shown in FIGS. 2 and 3, arranged along a straight line at prescribed intervals and grounded. Neutralization can take place when the transfer medium S, comprising paper or a synthetic resin, serving as an object of neutralization, passes by the neutralizing member.

In the image forming apparatus shown in FIG. 1, the neutralizing member 23 shown in FIGS. 2 and 3 is arranged on the back side of the toner images on the transfer medium S at the delivery portion of the transfer medium S from the transfer roller 35 to the fixing unit 18. The clearance (a value represented later by D) between the transfer medium, which is an object to be charged in this case, and the neutralizing member 23 is set at about 4.8 mm. The term "clearance" means the smallest distance achieved as a result of displacement of the transfer medium S. The tips of the saw teeth, which are projections of the neutralizing member, are equally spaced from each other by about 5.0 mm (a value represented later by P). The transfer medium, which is the object of neutralization, is more uniformly neutralized by the neutralizing member, thereby preventing the occurrence of a defective image. (Various experiments were carried out when setting the above-mentioned neutralizing member in this embodiment, the details of which will be separately described later.)

If the neutralizing member 23 is not provided, the transfer medium S becomes highly charged to a large extent since the transfer medium S is subjected to the transfer process during passage through the nip portion of the intermediate transfer belt 31 and the transfer roller 35, whereby a high potential of about −3,000 V is applied to maintain the charge. When the unfixed toner images on the transfer medium S are conveyed to the fixing unit 18 while maintaining the charge, the transfer medium S undergoes an abnormal discharge occurring on a conveying guide and on the back of the transfer medium S during the period until fixing thereof, and the toner images transferred onto the transfer medium S are disturbed along the discharge pattern. Particularly when the transfer medium S is dry as when forming images in a low-temperature low-humidity environment, or when forming images on a second surface in two-sided images, the transfer medium S has a high resistance, tends to be easily charged and the charge is hard to attenuate, thus easily causing the above-mentioned abnormal discharge.

In the present embodiment, the neutralizing member 23 is arranged between the transfer roller 35 on the recording medium conveying path and the fixing unit 18 as shown in FIGS. 1 and 2 for the purpose of preventing disturbance of images caused by this abnormal discharge. In the above-mentioned configuration, the back of the transfer medium S is stably and efficiently neutralized. During the period until the transfer medium S is conveyed to the fixing unit 18 and fixing is completed, it is possible to prevent an abnormal disturbance of images caused by the abnormal discharge with the conveying guide.

The neutralizing member 23 and the transfer roller 35 are arranged at positions such that the smallest distance therebetween is about 5 mm. This is for preventing leakage between the neutralizing member 23 and the transfer roller 35.

[Experiments for Installation of Neutralizing Member]

Upon installing the neutralizing member, the present inventors correlated the defective image with the shape of the neutralizing member and recognized an important effect on the image quality of the distance between tips of projections of the neutralizing member and the distance between the tip of the neutralizing member and the object of neutralization. The inventors found that these parameters were predominant by providing many kinds of neutralizing member and repeatedly passing the transfer media S therethrough. The present inventors further carried out the following experiments to see what influence these parameters had, and finally found an optimum relationship. The settings in the above-mentioned embodiments reflect the result of the following experiments. The experiments will now be described in detail.

[Experiment 1]

The distance (clearance D) between the tip of the neutralizing member (231 in FIG. 3) and the transfer medium S, which is an object of neutralization, and the distance between the tips of the neutralizing member were relatively varied, and an image was outputted. The result is as shown in FIG. 4. Absence of disturbance in the image is represented by "o", and the presence of image disturbance, is represented by "x". A saw-toothed neutralizing member was employed (hereinafter referred to as the "saw-toothed neutralizing member"). The pitch P between the tips (231) of the saw-toothed neutralizing member (hereinafter referred to as "P") was uniform for the sake of easy understanding and for the sake of experimental convenience.

According to the result, when the clearance D is fixed, the appropriate pitch P (mm) is within a certain range, and to prevent occurrence of a defective image at a larger clearance D, the pitch P (mm) must also be larger.

[Experiment 2]

The reason for occurrence of a defective image with a fixed pitch P of the neutralizing member and a smaller distance of the object of neutralization was verified by outputting half-tone images. As a result, image defects of image were found to occur at a certain pitch. In addition, the output image was collated with the image conveying path to confirm the relationship between points of occurrence and the shape of the saw-toothed neutralizing member. It was confirmed that the pitch corresponds to the distance between the tip portions of the saw-toothed neutralizing member (see FIG. 5). Efforts to clarify the mechanism of occurrence of a defective image by means of this phenomenon permit estimation of the following mechanism.

FIG. 5 schematically illustrates the transfer medium S and the neutralizing member 23. The range within which the neutralizing member 23 can neutralize the transfer medium S depends upon the distance from the tips 231 of the teeth. The neutralizable range of a certain distance is within a circular region having a certain radius with the tips 231 of the saw teeth as the center. As a result, when the pitch P (mm) becomes larger than an appropriate range relative to the clearance D, portions of the transfer mediums are not teeth by more than a certain distance, and as a result, when the pitch P (mm) becomes larger than an appropriate range relative to the clearance D, since there occur portions in which the transfer medium S is not neutralized in regions in which the distance from the tips 231 of the teeth is longer than a certain distance.

[Experiment 3]

The result of an experiment providing clues for clarification of the mechanism of occurrence of a defective image when the pitch of the neutralizing member is one-sidedly reduced will now be presented.

FIG. 6 illustrates, when a metal plate (assumed to be charged transfer medium S) is arranged opposite to the neutralizing member 23, and a potential difference of 3.0 kV is provided between the neutralizing member 23 and the metal plate, the relationship between the clearance D (mm) between the neutralizing member 23 and the metal plate, on the one hand, and the current (μA) flowing as a result of discharge between the neutralizing member 23 and the metal plate, on the other hand. FIG. 6 shows the clearance D (mm) and the current (μA) for the neutralizing members 23 having a pitch P (mm) of 2 mm, 4 mm, 6 mm and 8 mm, respectively.

At uniform pitch P, a larger clearance D (mm) between the neutralizing member 23 and the metal plate is suggested to lead to a smaller discharge current (μA). In other words, at a uniform pitch P, a large clearance D between the neutralizing member 23 and the transfer medium S results in a smaller neutralizing effect on thu transfer medium S. and this may cause the occurrence of a defective image. When the cleanmee D between the neutralizing member 23 and the metal plate is fixed, the result of this experiment suggests that a larger pitch leads to a larger neutralizing effect of the transfer medium S, thus inhibiting thu occurrence of a defective image.

This is attributable to the following fact. When the clearance D between the neutralizing member 23 and the metal plate is fixed, a larger pitch mm (an expected pitch) leads to concentration of electric field at the tips 231 of neighboring teeth, and interference between the tips 231 of the teeth is prevented.

Under the effect of the mechanism assumed above and from the result shown in FIGS. 4 and 5, a stable neutralizing performance can be obtained with a simple configuration through achievement of efficient concentration of the electric field by building a configuration satisfying the condition $0.8D \leqq P \leqq 1.5D$ as to the relationship between the pitch P (mm) and the clearance D (mm) between the saw-toothed electrode and the transfer medium S.

[Experiment 4]

The above-mentioned experiments are based on the result of single image forming runs. The following description concerns confirmation of the image quality of an image outputted after image forming on 50,000 A4-size pages. The result is shown in FIG. 8. As is understood from a comparison with FIG. 4, a clearance D set to a value smaller than 3 mm causes a problem in image quality.

According to the result, when durability is taken into account, it is necessary to separate the object of neutralization from the neutralizing member to some extent. The presence of the transfer medium, which is the object of neutralization, near the neutralizing member causes adhesion of dust and debris, such as toner or paper powder, to the neutralizing member, and this may cause uniformity of neutralization to be lost.

In a neutralizing member which carries out neutralization by discharging the object of neutralization by causing a discharge by the use of the potential difference between the neutralizing member and the transfer medium, a strong electric field is formed between the neutralizing member and the object of neutralization. If there is any dust in the proximity in this case, charged dust is attracted by the neutralizing member and adheres thereto. This is confirmed from the fact that a large neutralizing current flows according as the distance between the object of neutralization and the neutralizing member becomes smaller. Flow of neutralizing current in a larger amount leads to collection of much more dust. When dust adheres to the neutralizing member, abnormal discharge takes place at points of such adhesion (unexpected positions), and the expected neutralizing effect is not achieved. Particularly, the present embodiment achieves a uniform neutralizing effect from neutralization with the projections of the neutralizing member. It is therefore necessary to ensure a sufficient distance between the neutralizing member and the transfer medium so as to prevent dust from adhering to the neutralizing member and non-uniformity of discharge, as evaluated with various distances between the neutralizing member and the transfer medium, as shown in FIG. 7. Superposition of FIG. 7 on FIG. 4 results in FIG. 8.

The increase in the distance between the neutralizing member and the transfer medium S further makes it possible to avoid a jam caused by the transfer medium S catching on the neutralizing member, thus further preventing paper powder from adhering to the neutralizing member in jams.

For these reasons, the distance D between the neutralizing member and the object of neutralization is set at $D \geqq 4.0$.

From the results of the first to third experiments, the condition $0.8D \leqq P \leqq 1.5D$ must be satisfied with a large D value.

[From the Result of Experiments]

As is clear from the above-mentioned results of the experiments, a uniform and higher-quality image can be obtained, regarding the neutralizing member, by satisfying the conditions $0.8D \leqq P \leqq 1.5D$ and $D \geqq 4$.

In the above-mentioned experiments in this embodiment, an image forming apparatus using an intermediate transfer medium has been described. Also, in an image forming apparatus using transfer means carrying out a transfer directly from the photosensitive member, it is of course possible to obtain similar effects by arranging the neutralizing unit of this embodiment at the portion opposite to the transfer medium S.

The case where the transfer medium S is neutralized has been described above. There are similar problems also for the image forming apparatus using the transfer drum or the intermediate transfer medium as an object of neutralization.

The present embodiment has covered a case where the projections of the neutralizing member are equally spaced from each other. As is conceivable from the above-mentioned experiments, it is not always necessary to arrange them at equal intervals as long as the conditions given in the present invention are satisfied.

Second Embodiment

The second embodiment is characterized, as in the first embodiment, in that the transfer roller 35 is driven. According to the above-mentioned configuration, the transfer medium S passes through the nip portion of the intermediate transfer belt 31 and the transfer roller 35, and the behavior of the transfer medium during conveyance is stabilized. Particularly even when the weight of the transfer medium S changes, the behavior of the transfer medium S is harder to change, since the transfer medium S passes along the nip portion formed by the intermediate transfer belt 31 and the transfer roller 35. After passage through the nip portion of the intermediate transfer belt 31 and the transfer roller 35, the conveying direction becomes harder to vary.

When the pitch P of the neutralizing member 23 is fixed, as described above, in order to prevent occurrence of a defective image, it is necessary that the clearance D between the transfer medium S and the neutralizing member 23 be within a prescribed range.

As a result, as in the first embodiment, when the neutralizing member 23 is arranged between the transfer roller 35 and the fixing unit 18 on the conveyance path of the recording medium, and if the transfer roller 35 is driven as in this embodiment, the distance between the transfer medium S and the neutralizing member 23 is further stabilized.

In the present embodiment, therefore, even upon a change in the weight of the transfer medium, it is possible to expect a more stable neutralization of the transfer medium S, and to keep the image quality on a high level.

Third Embodiment

Figure 9:
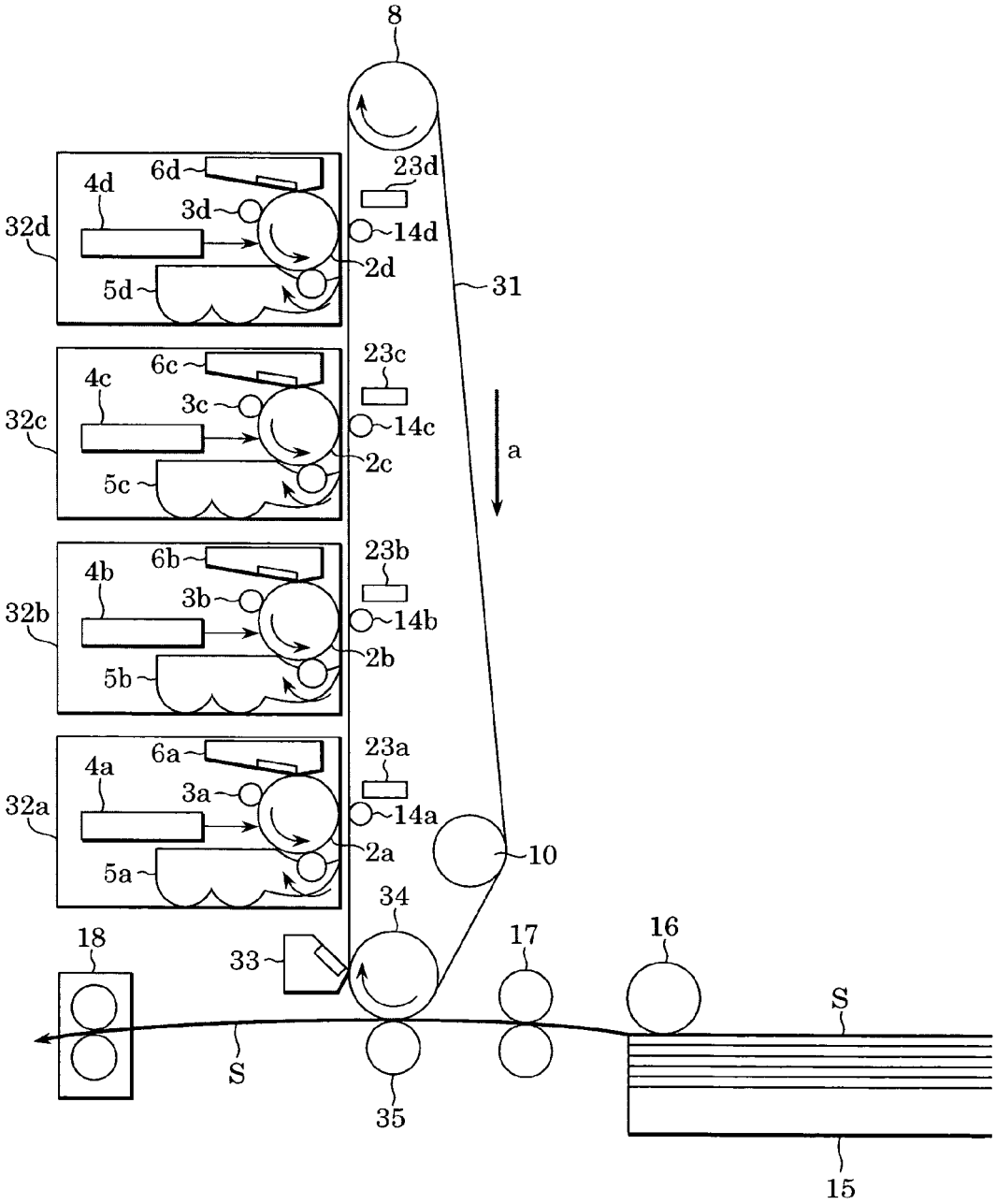
FIG. 9 is a sectional view illustrating a schematic configuration of a third embodiment of the image forming apparatus of the present invention.
Figure 10:
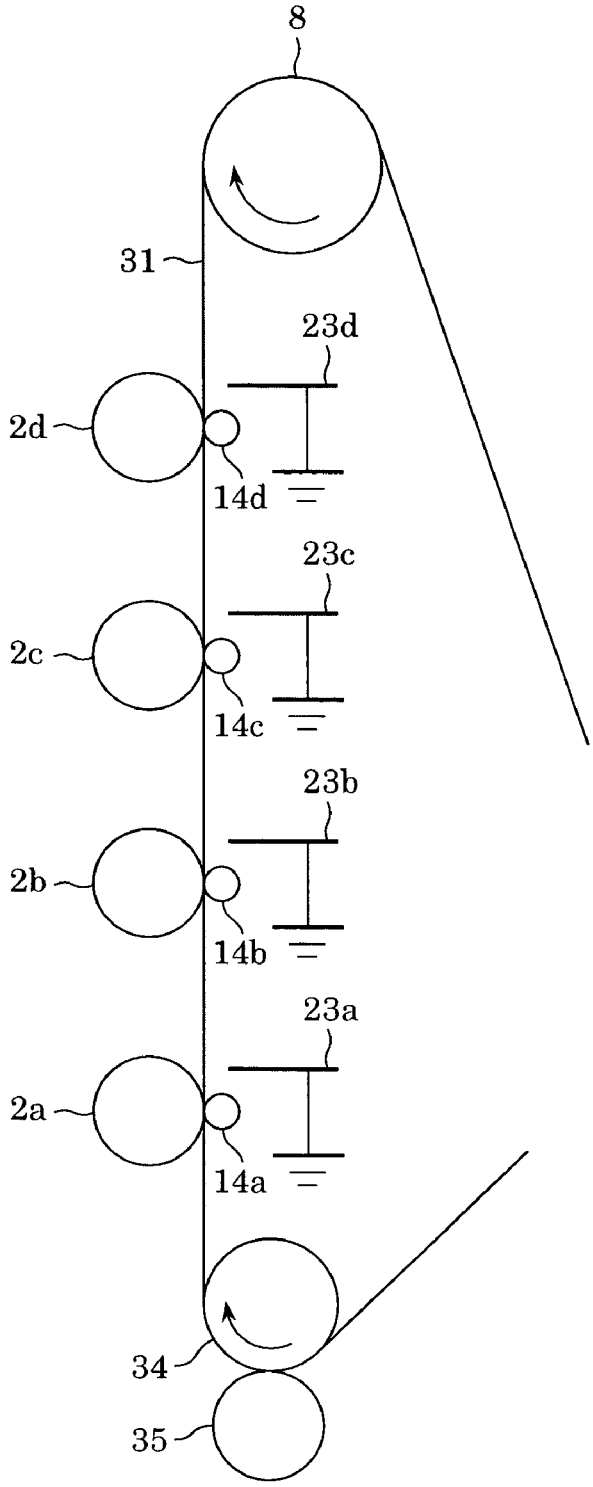
FIG. 10 is a partially enlarged view illustrating the layout configuration of a third embodiment of the neutralizing unit of the present invention.

A third embodiment of the image forming apparatus using the full-color electrophotographic method will be described in detail as an example of the neutralizing unit of the present invention and the image forming apparatus having such a neutralizing unit with reference to the drawings. FIG. 9 is a sectional view illustrating a schematic configuration of the image forming apparatus of the present invention. FIG. 10 is a partially enlarged view illustrating the layout configuration of the neutralizing unit of the present invention. For the same component parts as in the image forming apparatus described in the first embodiment, description will be omitted.

When passing through the four process stations 32*a* to 32*d*, the intermediate transfer belt 31 is subjected to a large amount of charge while undergoing the four transfer steps by the individual transfer rollers 14*a* to 14*d*. As a result, unless the charge on the back of the intermediate transfer belt 31 is neutralized, a defective transfer is caused at the process stations arranged in the downstream. The potential difference between the surface of the toner on the surface of the intermediate transfer belt 31 and the photosensitive drums grows lager, thus causing abnormal discharge. Upon occurrence of the abnormal discharge, the toner images on the intermediate transfer belt not fixed splashes, leading to occurrence of a defective image.

For the purpose of neutralizing the back of the intermediate transfer belt 31, therefore, as shown in FIGS. 9 and 10, the neutralizing member 23 is arranged at a position opposite to the intermediate transfer belt 31 in the downstream of the transfer rollers 14*a* to 14*d* in the intermediate transfer belt 31, and the mutual clearance (pitch) P (mm) of the tips 231 of the teeth of the toothed electrode 23 is set to about 5 (mm), and clearance D (mm) between the tips 231 of the teeth of the toothed electrode 23 of the charger 22 and the intermediate transfer belt 31 is set to about 5 (mm).

The individual neutralizing members 23*a* to 23*d* are arranged at positions such that the shortest distance to the respective transfer rollers 14*a* to 14*d* is about 5 mm. The value of 5 mm is adopted to prevent leakage between the neutralizing members 23*a* to 23*d* and the transfer rollers 14*a* to 14*d*.

According to the above-mentioned configuration, it is possible to carry out neutralization of the back of the intermediate transfer belt 31 by means of the neutralizing member 23, and thus to prevent occurrence of a defective transfer or a defective image caused by the abnormal discharge.

Fourth Embodiment

Figure 11:
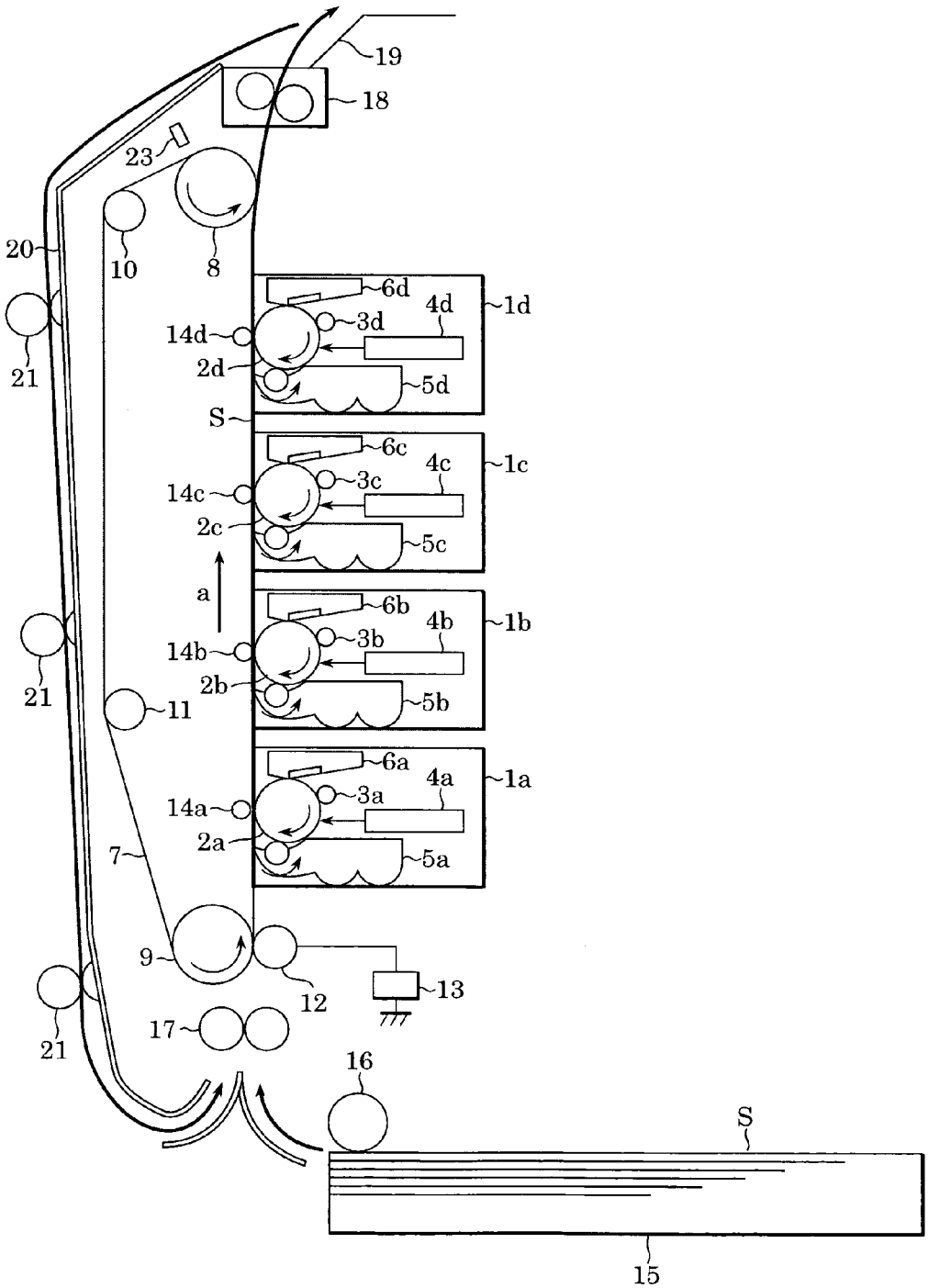
FIG. 11 is a sectional descriptive view illustrating a schematic configuration of a fourth embodiment of the image forming apparatus of the present invention.
Figure 12:
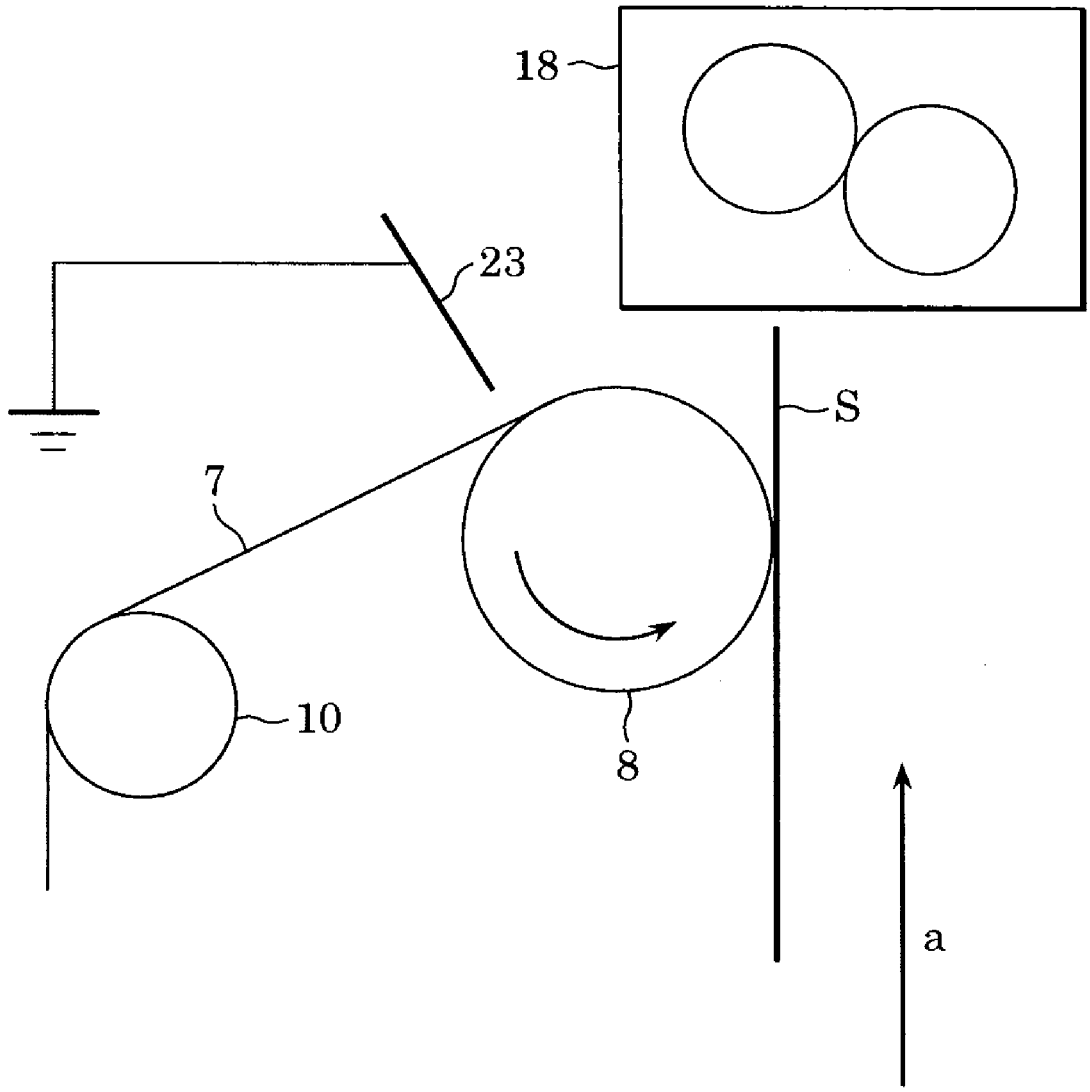
FIG. 12 is a partially enlarged view illustrating the layout configuration of the fourth embodiment of the neutralizing unit of the present invention.

A fourth embodiment of an image forming apparatus based on the full-color electrophotographic method will now be described in detail with reference to the drawings as an example of the neutralizing unit of the present invention and an image forming apparatus having such a neutralizing unit. FIG. 11 is a sectional view illustrating a schematic configuration of the image forming apparatus of this embodiment. FIG. 12 is a partially enlarged view illustrating the layout configuration of the neutralizing unit of this embodiment. Since the image forming apparatus of this embodiment is the same as the image forming apparatus described in the first embodiment in a usual image forming, description is omitted. The configuration of the image forming apparatus having the charging unit of the present invention will first be described with reference to FIG. 11. The image forming apparatus shown in FIG. 11 has a configuration in which four process stations 1*a*, 1*b*, 1*c* and 1*d*, serving as image forming means of four different colors including cyan, yellow, magenta and black are arranged, as an image forming apparatus based on the four-full-color electrophotographic method.

The process stations 1*a* to 1*d* have photosensitive drums 2*a*, 2*b*, 2*c* and 2*d*, serving as image carriers. The surfaces of the photosensitive drums 2*a* to 2*d* are uniformly charged by primary chargers 3*a*, 3*b*, 3*c* and 3*d* arranged around the individual photosensitive drums 2*a*, to 2*d*, and then, electrostatic latent images are formed through exposure based on image information by exposure units 4*a*, 4*b*, 4*c* and 4*d* such as LEDs (light emitting diodes) or lasers. These electrostatic latent images are developed to form toner images as a result of deposition of different kinds of toner of the individual colors by developing units 5*a*, 5*b*, 5*c* and 5*d*.

The individual process stations 1*a* to 1*d*, serving as process cartridges, are detachable from the image forming apparatus main body. These process cartridge have a configuration in which the individual photosensitive drums 2*a* to 2*d*, the primary chargers 3*a* to 3*d*, the developing units 5*a* to 5*d* and cleaning means 6*a*, 6*b*, 6*c* and 6*d* are integrally combined.

On the other hand, the transfer medium S, serving as a recording medium housed in a paper feed cassette 15, is sent into the image forming apparatus main body by a feeding roller 16, conveyed by resist roller pair 17, and then, electrostatically attracted by a transfer conveyor belt 7, serving as a transfer medium carrier by an attracting roller 12, to which a positive-pole attractive bias voltage is impressed by an attractive bias power source 13, to be carried and conveyed.

The transfer conveyer belt 7 is stretched by four rollers including a driving roller 8, an attracting counter roller 9, and tension rollers 10 and 11. Process stations 1*a*, 1*b*, 1*c*, and 1*d* of colors including cyan, yellow, magenta and black are substantially perpendicularly arranged to the surface of the transfer conveyor belt 7 and sequentially from an upstream side in the moving direction of the transfer conveyor belt 7 (the arrow "a" direction in FIG. 11).

Transfer rollers 14*a*, 14*b*, 14*c* and 14*d*, serving as transfer means, are arranged on the inside of the transfer conveyor belt 7 opposite to the respective photosensitive drums 2*a* to 2*d*. When the transfer medium S, attracted by the transfer conveyor belt 7, passes sequentially through the process stations 1*a* to 1*d* of the respective colors, toner images of the respective colors carried on the photosensitive drums 2A to 2*d* by means of the respective transfer rollers 14*a* to 14*d* are sequentially transferred electrostatically onto the surface of the transfer medium S.

A fixing unit 18, serving as fixing means, is arranged in the downstream in the recording medium conveying direction of the transfer roller 14*d* on the most downstream side, serving as transfer means.

The transfer medium S onto which the toner images have been transferred from the photosensitive drums 2*a* to 2*d* by the transfer rollers 14*a* to 14*d* is conveyed to the fixing unit 18 after separation from the peripheral surface of the driving roller 8. Through heating and pressurizing in the fixing unit 18, the toner images are fixed onto the transfer medium S. After a permanent image is thus formed, the fixed image is discharged onto a discharge tray 19 provided outside the apparatus.

Residual toner remaining on the photosensitive drums 2*a* to 2*d* is collected by respective cleaning means 6*a* to 6*d*, thus cleaning the surface of the photosensitive drums 2*a* to 2*d*.

When images are formed on two sides of the transfer medium S, the transfer medium S discharged onto the discharge tray 19 is fed again by a re-feed guide 20 and a re-feed roller 21 and reversed. In the same manner as above, the transfer medium S is electrostatically attracted by the transfer conveyor belt 7 and carried and conveyed. After forming the toner images on the second side by means of the process stations 1*a*, 1*b*, 1*c* and 1*d* and the transfer rollers 14*a* to 14*d*, and after separation from the peripheral surface of the driving roller 8, the toner images are fixed on the transfer medium S in the fixing unit 18, and discharged onto the discharge tray 19 provided outside the apparatus.

In the image forming apparatus shown in FIGS. 11 and 12, the neutralizing member 23 is arranged on the portion opposite to the transfer conveyor belt 7 to neutralize the transfer conveyor bet 7.

When passing through the four process stations 1*a* to 1*d*, the transfer medium S is subjected to a large amount of charge while undergoing four transfer steps by the transfer rollers 14*a* to 14*d*, and for example, a high potential of about −3,000V is impressed to keep the charge. When the transfer medium S is separated from the transfer conveyor belt 7, a potential difference between the transfer medium S and the surface of the transfer conveyor belt 7 causes peeling discharge. A charge is therefore imparted onto the surface of the transfer conveyor belt 7. Usually, the charge on the surface of the transfer conveyor belt 7 escapes through the tension rollers upon passing through the tension rollers 10 and 11, and decreases. Upon arrival at the attracting roller 12, the amount of charge on the surface of the transfer conveyor belt 7 is on such a level that there occurs no defective attraction of the transfer medium S or no defective transfer. However, particularly when the transfer medium S has a high resistance, and upon image forming or two-sided image forming in a low-temperature low-humidity environment tending to permit easy charging, paper is once continuously fed while forming an image on the second side of a transfer medium dried through the fixing step during image forming on the first side, a larger amount of charge is imparted when the transfer medium S passes through the four process stations 1*a* to 1*d*. When separating the transfer medium S from the transfer conveyor belt 7, therefore, the potential difference between the transfer medium S and the surface of the transfer conveyor belt 7 becomes larger, leading to a larger amount of charge imparted to the surface of the transfer conveyor belt 7. In a low-temperature, low-humidity environment, furthermore, resistance of the transfer conveyor belt 7 becomes higher. Therefore, during passage through the tension rollers 10 and 11, a smaller amount of charge of the surface of the transfer conveyor belt 7 escapes through the tension roller. The amount of charge on the surface of the transfer conveyor belt 7 at the moment of arrival at the attracting roller 12 reaches such a level that a defective attraction or a defective transfer of the transfer medium S can occur.

For the purpose of preventing the charge-up of the transfer conveyor belt 7, the neutralizing member 23 is arranged at a position opposite to the driving roller 8; the mutual clearance P (mm) of the tips 231 of the teeth of the toothed electrode 23 is set to about 5 (mm), and the clearance D (mm) between the tips 231 of teeth of the toothed electrode 23 of the charger 22 and the transfer conveyor belt 7 is set to about 5 (mm).

According to the above-mentioned configuration, it is possible to efficiently conduct neutralization of the surface of the transfer conveyor belt 7 by means of the neutralizing member 23, and prevent occurrence of a defective attraction or a defective transfer of the transfer medium S.

Fifth Embodiment

Figure 13:
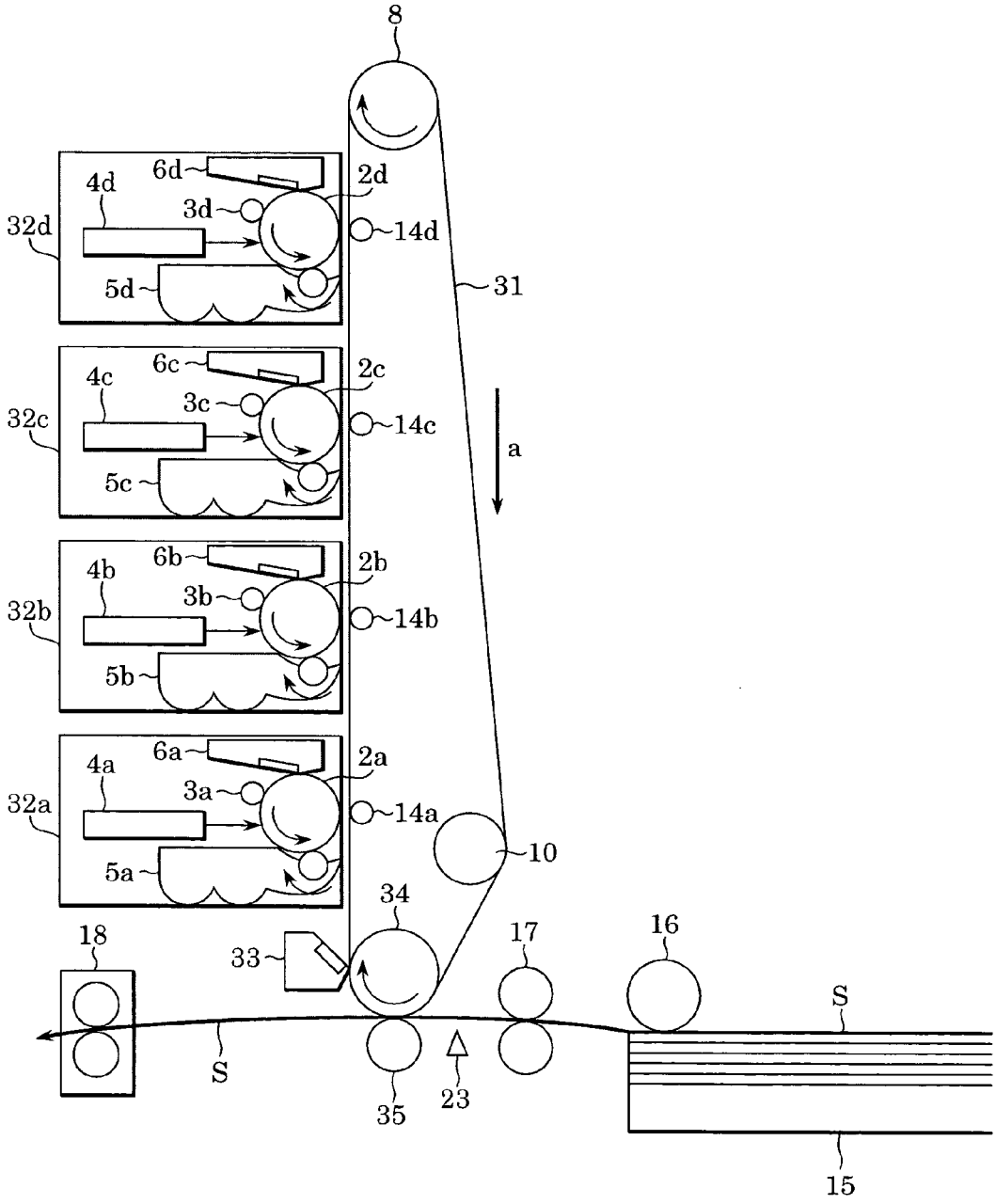
FIG. 13 is a sectional view illustrating the configuration of a fifth embodiment of the image forming apparatus of the present invention.

The image forming apparatus in this embodiment of the present invention utilizes an intermediate transfer medium, and carries out neutralization of the transfer medium S prior to transfer of toner images from the intermediate transfer medium. When the transfer medium S itself is charged, the neutralizing means 23 is arranged as shown in FIG. 13, and neutralization is conducted in advance to ensure stable transfer performance. The image forming apparatus covered by this embodiment has a configuration in which toner images are transferred by this electric field between the transfer medium S and the intermediate transfer medium. If the transfer medium S is charged, the above-mentioned electric field for neutralization does not become a desired one, thus making it impossible to perform a stable transfer operation. This embodiment prevents such an inconvenience. More specifically, this embodiment has substantially the same configuration as that of the image forming apparatus shown in the first embodiment, that is, the same configuration as that of the image forming apparatus shown in FIG. 1 presented in the first embodiment, except the arrangement of the neutralizing member 23. The description is therefore omitted here except for the arrangement of the neutralizing member 23.

The image forming apparatus of this embodiment carries out neutralization by means of the neutralizing member 23 prior to the advance of the transfer medium S to a position where the toner image are transferred from the intermediate transfer medium. The neutralizing member is arranged at a position in the upstream by about 10 mm from the nip position formed between the transfer roller 35 and the intermediate transfer medium in the moving direction of the transfer medium S. Even if it is probable that the transfer medium S is charged on the conveyance path of the transfer medium S, this position eliminates the probability, thus ensuring satisfactory transfer performance. The mutual clearance (pitch) P between the tips 231 of the teeth of the toothed electrode 23 for which the neutralizing member is set to about 5 (mm), and the clearance D (mm) between the tips 231 of the teeth of the toothed electrode 23 of the charger 22 and the transfer medium S is set to about 5 (mm).

The neutralizing mechanism based on this neutralizing member eliminates the necessity of setting a transfer bias by taking into account the charging condition of the transfer medium S. This effect is useful particularly when forming images on the second side while conducting two-sided image forming, or when, in a low-humidity environment, a high resistance value of the transfer medium S tends to easily cause charging.

Sixth Embodiment

Figure 14:
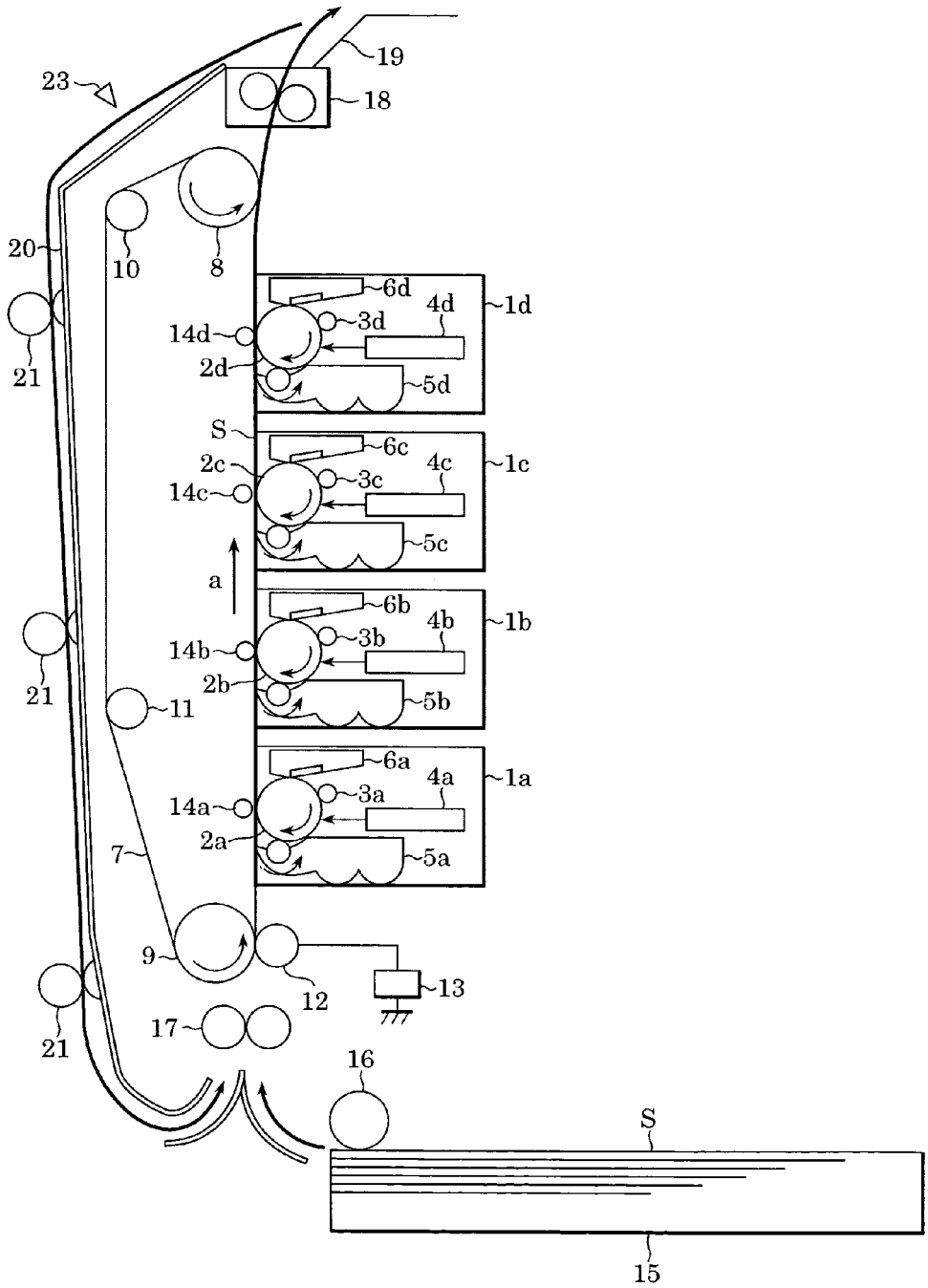
FIG. 14 is a sectional view illustrating the configuration of a sixth embodiment of the image forming apparatus of the present invention.

In this embodiment, a case of neutralizing the transfer medium S, other than in the step of forming toner images on the transfer medium, will be presented. The image forming apparatus of this embodiment has basically the same configuration as that of the image forming apparatus presented in the third embodiment as shown in FIG. 14, except that the neutralizing member has a mechanism for neutralizing the transfer medium S subjected to image forming on the second side from among the sides of the transfer medium after passage through the fixing unit. Reference numeral 23 in FIG. 14 represents the neutralizing member. The shape of the neutralizing member and the distance from the transfer medium S which is the object of neutralization are the same as those in the fifth embodiment. By arranging them at these positions, the transfer medium S is prevented from adhering to the metal plate or the like on the conveyance path of the transfer medium, and finally occurrence of a jam is inhibited.

In the image forming apparatus before arranging this neutralizing member 23, a jam has often been caused in the conveyance path of the transfer medium after passage through the fixing unit. In the fixing unit of this embodiment, a bias is applied between the fixing roller and the pressurizing roller to prevent electrostatic offsetting of the toner images. In this configuration, therefore, the transfer medium S having passed through the fixing unit is temporarily charged. Since the transfer medium S having once passed through the fixing unit is dried and curls, a strong adhering force acts when a metal plate is installed in the paths having curved portions from among the conveyance paths of the transfer medium S. Particularly, a curl of the transfer medium S depends upon the toner images formed on the transfer medium S. When heated, there is a considerable difference in the contracting rate between the transfer medium S itself and the toner.

In this embodiment of the present invention, therefore, occurrence of a jam is prevented by neutralizing in advance the transfer medium S which has to enter the conveyance path of the transfer medium again after passage through the fixing unit. Since it is on the conveyance path and the toner images have already been fixed onto the transfer medium S, it is possible for the neutralizing member 23 to utilize those in contact with the transfer medium S, but actually, the transfer medium may be damaged; the transfer medium S may be caught by the neutralizing member, thereby causing a jam; or the neutralizing member 23 may be partially broken and debris scatters on the conveyance path in all probabilities. It is therefore desirable that the transfer medium be kept non-contact, and a non-contact neutralizing configuration as in this embodiment is adopted.

Seventh Embodiment

Figure 16:
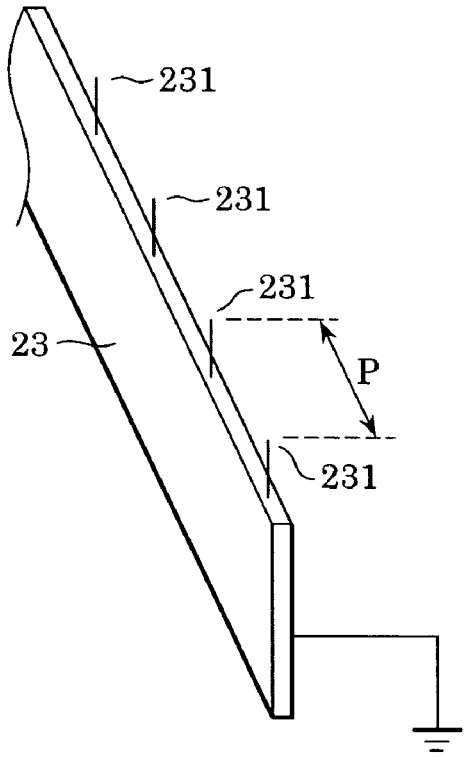
FIG. 16 is a perspective view illustrating the configuration of a eighth embodiment of the neutralizing unit of the present invention.

Toothed neutralization members have been presented as neutralizing members in the above-mentioned first to sixth embodiments. In order to obtain advantages of the present invention, however, the only requirement is to have sharp members. A neutralizing member having needle-shaped projections was therefore used in place of the saw-toothed neutralizing member in these embodiments. Similar effects were obtained in all cases. This needle-shaped neutralizing member is illustrated in FIG. 16. In the present invention, the neutralizing member has a sharp portion on which the electric field can be concentrated so that, as long as the pitch P of the tip portions and the distance D from the object of neutralization are satisfactory, the same advantages can be obtained in all cases.

Eighth Embodiment

Figure 15:
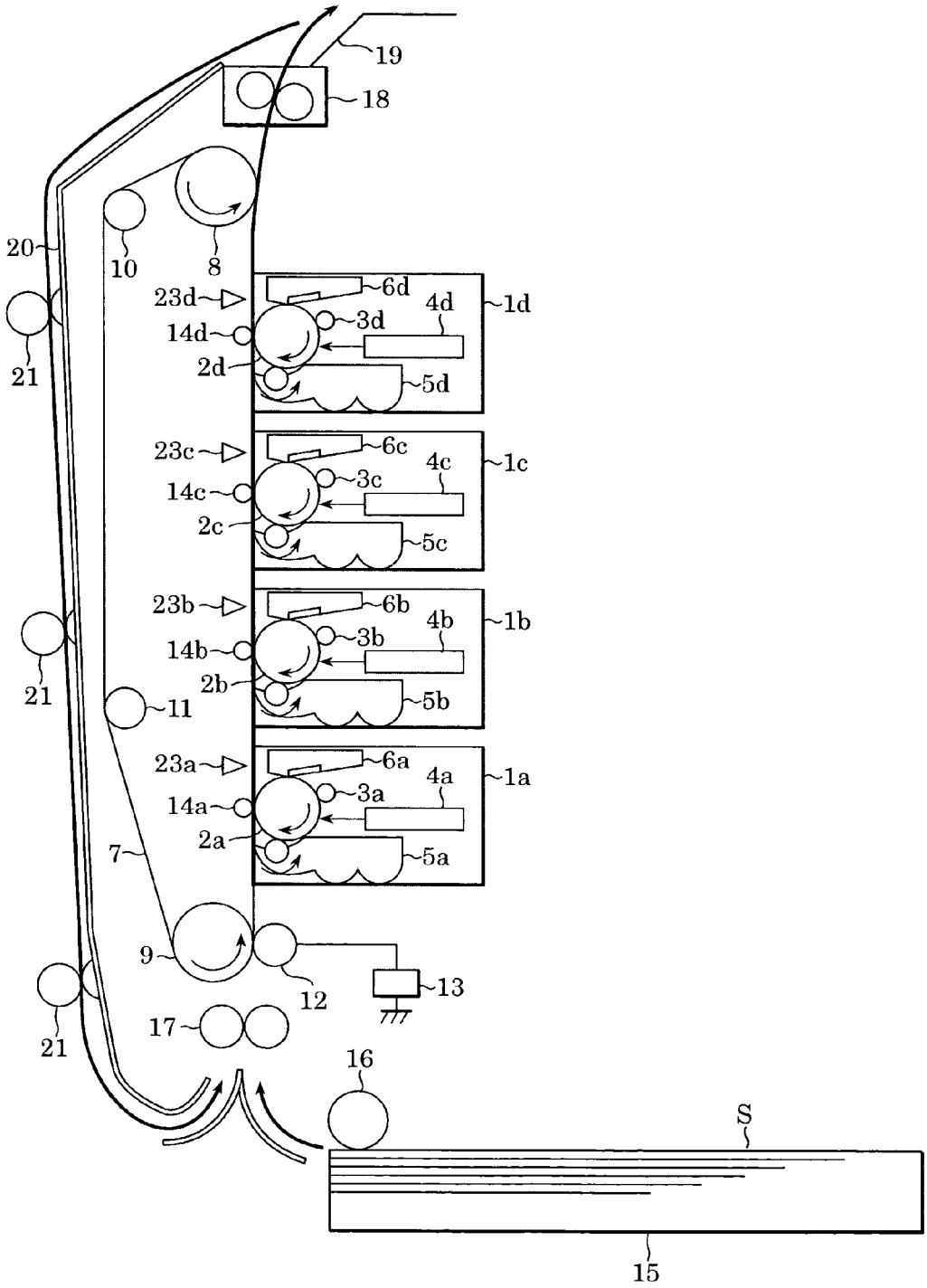
FIG. 15 is a sectional view illustrating the configuration of a seventh embodiment of the image forming apparatus of the present invention.

The above-mentioned third embodiment has presented a configuration in which, by use of an intermediate transfer belt 31, neutralization is performed from the back of the intermediate transfer belt 31 while passing through the individual process stations 32*a* to 32*d*. This embodiment presents a configuration in which neutralization is conducted from the back of the transfer medium conveyor belt 7. This configuration is illustrated in FIG. 15.

In the individual process stations, transfer rollers 14*a* to 14*d* carry out four transfer steps. As a result, charging is repeated upon every passage of the transfer medium S and the transfer medium conveyor belt 7 through the respective process stations. In this manner, when applying a charge to the transfer medium in the transfer step, the transfer bias at the process stations in the downstream must sequentially be increased.

This may sometimes cause an inconvenience in that it is necessary to increase the capacity of the power source which supplies the transfer bias. An abnormal discharge may take place with metal plates near the course of passage of the transfer medium conveyor belt 7 and the transfer medium S.

In this embodiment, therefore, the neutralizing member is arranged in the downstream of the transfer mechanism in each process station to permit neutralization of the transfer medium conveyor belt 7 and the transfer medium S after the completion of the transfer step.

Ninth Embodiment

Figure 17:
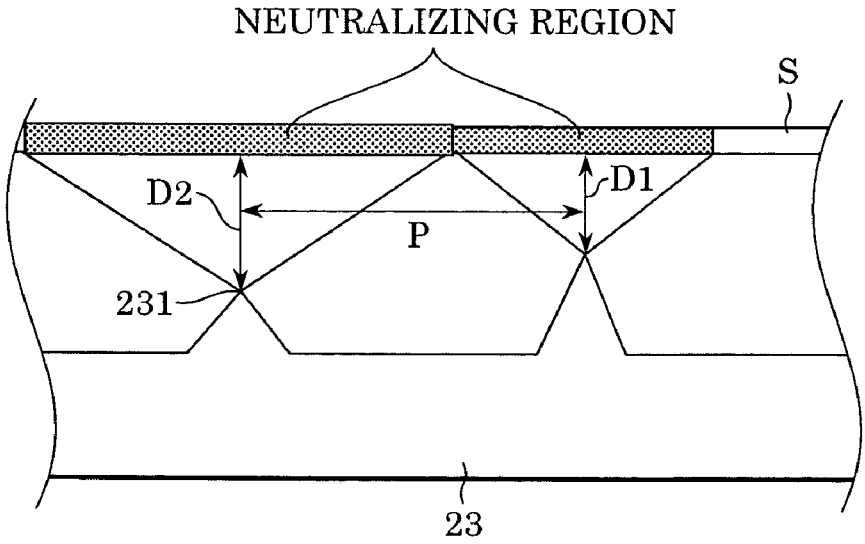
FIG. 17 illustrates a ninth embodiment of the neutralizing unit of the present invention.
Figure 18:
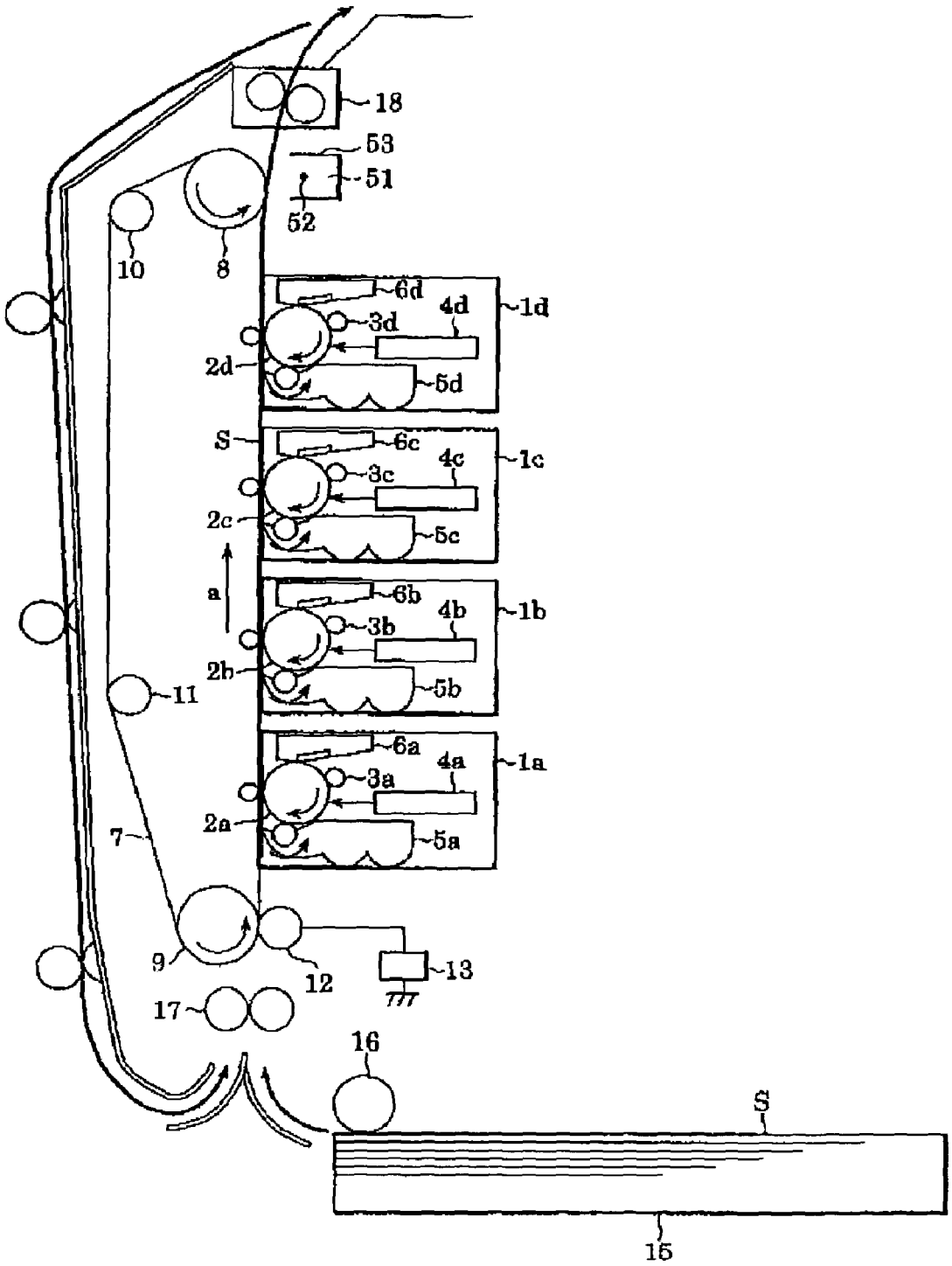
FIG. 18 PRIOR ART
FIG. 18 illustrates the configuration of a conventional neutralizing unit.
Figure 19:
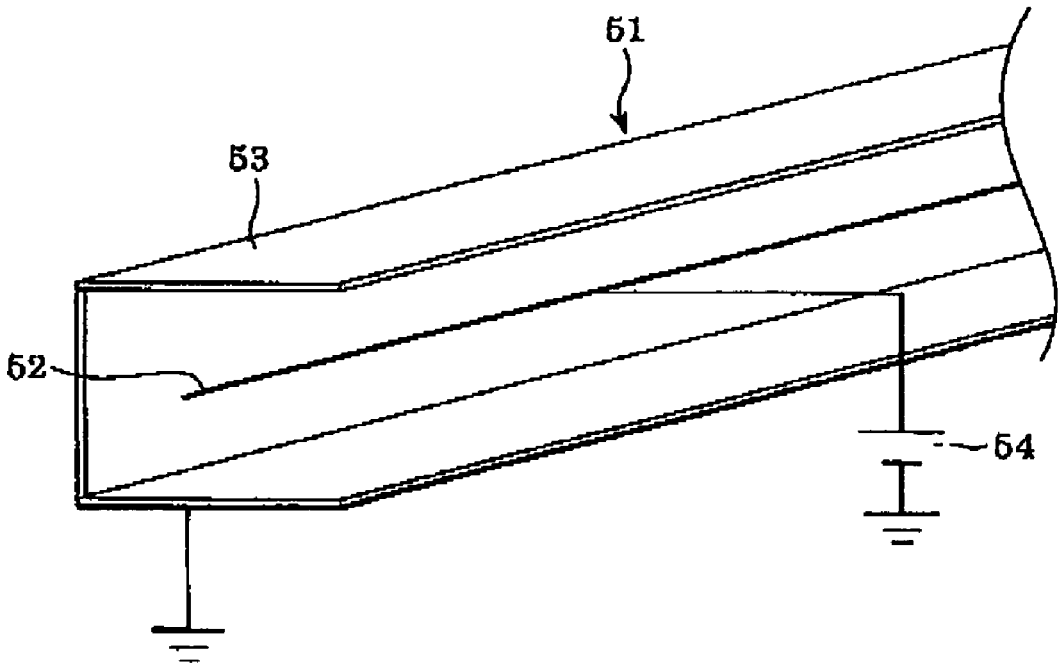
FIG. 19 PRIOR ART
FIG. 19 illustrates the configuration of the wire-type corona charger.

In the above-mentioned first to eighth embodiments, the distance between the tips 231 of the neutralizing member and the member to be neutralized has been treated as the same D in all cases. In order to obtain the advantages of the present invention, however, it is not always necessary to use the same distance between the tip of the neutralizing member and the member to be neutralized in all cases. As shown in FIG. 17, the advantages of the present invention were obtained even by using a distance P between the tips at the position of the neutralizing member of 4.8 mm, and distances between the tips of both sides and the member to be neutralized D1 (mm) and D2 (mm) of D1=5.0 and D2=5.8, respectively. If the above-mentioned relationship between P and D is satisfied, an efficient neutralization is possible from the member to be neutralized. In other words, on the assumption that, in order to ensure durability of the neutralizing member simultaneously with an appropriate concentration of electric fields, the only requirement was to satisfy conditions D≧4.0 and 0.8*D≦P≦1.5*D, D1 and D2 were set as follows, respectively:

$$D1 \geqq 4.0,\ 0.8*D1 \leqq P \leqq 1.5*D1, \text{ and}$$

$$D2 \geqq 4.0,\ 0.8*D2 \leqq P \leqq 1.5*D2,$$

And the result showed that the advantages of the present invention were available under these conditions.

In the above-mentioned embodiments, the printer was presented as an example of the image forming apparatus. However, the present invention is not limited to this, but is applicable to other image forming apparatuses including copying machines and facsimile machines, and other image forming apparatuses such as a composite machine built by combining these functions. Similar effects can be obtained by applying the present invention to any of these image forming apparatuses.

While various embodiments of the present invention have been described above, the intent and the scope of the present invention are not limited to specific description and drawings within this specification.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2003-39883 filed Nov. 28, 2003, which is hereby incorporated by reference herein.

The invention claimed is:

1. An image forming apparatus operable to form images on a transfer medium, the apparatus comprising:

a carrier configured to carry the transfer medium along a moving path;

a neutralizing member configured to neutralize the transfer medium; and the neutralizing member including a first projection and a second projection adjacent to the first projection, wherein the first and second projections have first and second tip portions, respectively, and wherein the first and second tip portions are configured to neutralize the transfer medium, wherein a minimum distance (D1) between the first tip portion and the moving path of the transfer medium, a minimum distance (D2) between the second tip portion and the moving path of the transfer medium, and a distance (P) between the first tip portion and the second tip portion satisfy the following expressions:

$$D1 \geqq 4.0 \text{ mm},\ 0.8*D1 \leqq P \leqq 1.5*D1$$

$$D2 \geqq 4.0 \text{ mm},\ 0.8*D2 \leqq P \leqq 1.5*D2.$$

2. The image forming apparatus according to claim 1, wherein the minimum distance (D1) is substantially equal to the minimum distance (D2).

3. The image forming apparatus according to claim 1, further comprising a transfer unit facilitating transfer of toner images onto the transfer medium and being disposed along the moving path, wherein the neutralizing member is disposed immediately downstream to the transfer unit along the moving path.

4. The image forming apparatus according to claim 1, further comprising a transfer unit facilitating transfer of toner images onto the transfer medium and being disposed along the moving path, wherein the neutralizing member is disposed immediately upstream to the transfer unit along the moving path.

5. The image forming apparatus according to claim 1, wherein the moving path of the transfer medium includes a reversing path facilitating forming images on both sides of the transfer medium, and wherein the neutralizing member is disposed along the reversing path.

6. An image forming apparatus comprising:

a toner-image carrier configured to carry a toner image; and a neutralizing member configured to neutralize the toner-image carrier, wherein the neutralizing member includes:

a first projection and a second projection adjacent to the first projection, wherein the first and second projections have first and second tip portions, respectively, wherein the first and second tip portions are configured to neutralize the toner-image carrier, wherein a minimum distance (D1) between the first tip portion arid the toner image carrier, a minimum distance (D2) between the second tip portion and the toner image carrier, and a distance (P) between the first tip portion and the second tip portion satisfy the following expressions:

$$D1 \geqq 4.0 \text{ mm}, \ 0.8*D1 \leqq P \leqq 1.5*D1$$

$$D2 \geqq 4.0 \text{ mm}, \ 0.8*D2 \leqq P \leqq 1.5*D2.$$

7. The image forming apparatus according to claim 6, wherein the minimum distance (D1) is substantially equal to the minimum distance (D2).

8. The image forming apparatus according to claim 7, wherein the toner image carrier is operable to transfer the toner image at a plurality of transfer positions, and wherein the neutralizing member is disposed between the plurality of transfer positions.

9. The image forming apparatus according to claim 6, wherein the toner image carrier is operable to transfer the toner image at a plurality of transfer positions, and wherein the neutralizing member is disposed between the plurality of transfer positions.

10. An image Conning apparatus comprising:

a conveyor configured to convey toner images; and a neutralizing member configured to neutralize the conveyor, wherein the neutralizing member includes a first projection and a second projection adjacent to the first projection, wherein the first and second projections have first and second tip portions, respectively, wherein the first and second tip portions are configured to neutralize the conveyor, and wherein a minimum distance (D1) between the first tip portion and the conveyor, a minimum distance (D2) between the second tip portion and the conveyor, and a distance (P) between the first tip portion and said second tip portion satisfy the following expressions:

$$D1 \geqq 4.0 \text{ mm}, \ 0.8*D1 \leqq P \leqq 1.5*D1$$

$$D2 \geqq 4.0 \text{ mm}, \ 0.8*D2 \leqq P \leqq 1.5*D2.$$

11. The image forming apparatus according to claim 10, wherein the minimum distance (D1) is substantially equal to the minimum distance (D2).

12. The image forming apparatus according to claim 10, further comprising a driver driving the conveyor, wherein the neutralizing member is disposed about the driver.

13. The image forming apparatus according to claim 10, further comprising a transfer roller, wherein the neutralizing member is disposed about the transfer roller.

* * * * *